US008230767B2

(12) United States Patent
Frommelt et al.

(10) Patent No.: US 8,230,767 B2
(45) Date of Patent: Jul. 31, 2012

(54) FASTENER DRIVING TOOL FOR AN INSULATION MATERIAL PLUG

(75) Inventors: Markus Frommelt, Schaan (LI); Michael Sproewitz, Feldkirch-Tisis (AT)

(73) Assignee: Hilti Aktiengesellschaft, Schaan (LI)

( * ) Notice: Subject to any disclaimer, the term of this patent is extended or adjusted under 35 U.S.C. 154(b) by 330 days.

(21) Appl. No.: 12/592,370

(22) Filed: Nov. 24, 2009

(65) Prior Publication Data

US 2010/0218649 A1 Sep. 2, 2010

(30) Foreign Application Priority Data

Nov. 27, 2008 (DE) ..... 10 2008 044 124

(51) Int. Cl.
*B25B 23/157* (2006.01)

(52) U.S. Cl. ..... 81/474; 81/467

(58) Field of Classification Search ..... 81/473–476, 81/184, 121.1, 177.85, 429, 53.2, 438, 439, 81/451, 467
See application file for complete search history.

(56) References Cited

U.S. PATENT DOCUMENTS 4,988,281 A * 1/1991 Heathe et al. ..... 425/559
5,682,800 A * 11/1997 Jore ..... 81/429

FOREIGN PATENT DOCUMENTS

DE 10 2007 000 235 10/2008

* cited by examiner

*Primary Examiner* — Hadi Shakeri
(74) *Attorney, Agent, or Firm* — Davidson, Davidson & Kappel, LLC

(57) ABSTRACT

A fastener driving tool for an insulation material plug that anchored with a fastener in the substrate has a first drive shaft and a second drive shaft. The first drive shaft has a shank extending along a longitudinal axis having a first rotary carrier for the fastener at a first end and that has a second rotary carrier second end. The second drive shaft has a hollow shank with a third carrier means for the insulation material plug at a first end. A coupler is provided that can be disengaged by axial pressure and arranged at a distance from the first end. The coupler has locking elements that engage into recesses in order to transfer a torque from the first drive shaft to the second drive shaft. Grooves guide the locking elements are adjacent to a recess and, extend helically along the circumference.

7 Claims, 3 Drawing Sheets

FASTENER DRIVING TOOL FOR AN INSULATION MATERIAL PLUG

This claims the benefits German Patent Application No. 10 2008 044 124.4, filed Nov. 27, 2008 and hereby incorporated by reference herein.

The invention relates to a fastener driving tool for an insulation material plug that can be anchored with a fastening means in the substrate.

BACKGROUND

So-called insulation material plugs having a shank with an anchoring section at one end and a disk-shaped other end are employed in order to attach insulation panels. A hole is drilled into the substrate all the way through the insulation panel. Subsequently, the end of the insulation material plug facing the anchoring section is inserted into the hole and then anchored in the substrate using a fastening means such as, for example, an expanding screw. Once the insulation material plug has been driven in, the disk-shaped end lies on the surface of the insulation panel or else it is sunk into the insulation panel.

German patent application DE 10 2007 000 235 A1 discloses a fastener driving tool for an insulation material plug that can be anchored in the substrate using a fastening means and, instead of the pressure disk, said plug has an insulation material thread that penetrates into the insulation while the insulation material plug is being driven in. The fastener driving tool has a first drive shaft that has a shank extending along the longitudinal axis, that has a first rotary carrier means for the fastening means at a first end and that has a second rotary carrier means for a fastener driving tool device at a second end opposite from the first end. Moreover, the fastener driving tool has a second drive shaft that is arranged coaxially to the first drive shaft and that has a hollow shank with a third carrier means for the insulation material plug at a first end. Furthermore, a coupler is provided that can be disengaged by means of axial pressure and that is arranged in an area at a distance from the first end of the second drive shaft and that includes at least one locking element that engages into at least one recess in order to transfer a torque from the first drive shaft to the second drive shaft.

When the free end of the second drive shaft that faces the insulation material and that is provided with an axially adjustable stop disk comes into contact with the insulation material when the insulation material plug is being driven in, then the coupler disengages when the fastener driving tool advances further in the fastener driving direction and the transfer of the torque from the first driveshaft to the second drive shaft is interrupted. As a result, only the first drive shaft of the fastener driving tool continues to be driven, until the insulation material plug is anchored in the substrate using the fastening means. Once the fastener driving procedure has been completed, the user moves the first drive shaft relative to the second drive shaft until the coupler latches in order to once again transfer the torque from the first drive shaft to the second drive shaft, as a result of which the fastener driving tool is once again ready for the next fastener driving procedure. Insulation material plugs can be driven to different depths via the axially adjustable stop disk, for instance, taking into consideration the thickness of the insulation material.

SUMMARY OF THE INVENTION

This fastener driving tool stands out especially for its simple handling and the high flexibility regarding the fact that insulation material plugs of different sizes can be driven to different depths into the substrate.

It is an object of the present invention to put forward a fastener driving tool for an insulation material plug that can be anchored in the substrate using a fastening means, and said tool is even easier to operate and especially simplifies the coupling of the disengaged coupler.

The present invention provides a fastener driving tool for an insulation material plug that can be anchored with a fastening means in the substrate, having a first drive shaft that has a shank extending along the longitudinal axis, that has a first rotary carrier means for the fastening means at a first end and that has a second rotary carrier means for a fastener driving tool device at a second end opposite from the first end, and with a second drive shaft that is arranged coaxially to the first drive shaft and that has a hollow shank with a third carrier means for the insulation material plug at a first end, as well as coupler that can be disengaged by means of axial pressure and that is arranged in an area at a distance from the first end of the second drive shaft and that includes at least one locking element that engages into at least one recess in order to transfer a torque from the first drive shaft to the second drive shaft. According to the invention, a groove to guide the at least one locking element is provided, said groove being adjacent to the at least one recess and, starting from the at least one recess, extending helically, at least in some areas, along the circumference in the direction of the second end of the first drive shaft.

Therefore, the groove to guide the at least one locking element extends from the recess axially in the direction of the second end of the first drive shaft and, at the same time, at least in some areas, it extends along the circumference of the first drive shaft.

Advantageously, relative to the surface of the corresponding part of the fastener driving tool on which the recess is arranged, said recess has a greater depth than the groove that is adjacent to the recess. However, this is not an absolute prerequisite, as a result of which the recess and the groove that is adjacent to this recess can be of the same depth. An essential aspect for the function of the recess is that, for purposes of transferring the torque from the first drive shaft to the second drive shaft, the locking element is held in the recess until a defined disengaging torque of the coupler has been reached.

As soon as an end area of the second drive shaft of the fastener driving tool facing the third carrier means is in contact with the surface of the insulating panel, also in the case of the fastener driving tool according to the invention, when the tool advances further in the fastener driving direction, then such a strong pressure can be exerted on the coupler that the at least one locking element is disengaged from the recess and subsequently slides along the shank of the first drive shaft. The coupler between the first drive shaft and the second drive shaft is now in the uncoupled state. As a result, the torque transfer from the first drive shaft to the second drive shaft, and thus to the insulation material plug, is interrupted. This is done without any action on the part of the user in one work step, always at the same fastener driving depth of the insulation material plug, said depth being determined, for example, on the basis of the stop disk that had previously been axially positioned. The first drive shaft of the fastener driving tool continues to be rotationally driven in order to actuate the fastening means and thus to anchor the insulation material plug in the substrate.

Once the fastener driving procedure has been completed, the first drive shaft can be moved relative to the second drive shaft, whereby the at least one locking element engages into the helically arranged groove of the locking element and is then guided by the groove until it enters the recess. As soon as the at least one locking element once again engages into the recess, the coupler between the first drive shaft and the second drive shaft is coupled once again, as a result of which a torque can be once again transferred from the first drive shaft to the second drive shaft, and the fastener driving tool is ready for the next fastener driving procedure.

As a result, the fastener driving tool becomes even easier to handle since, in order to carry out the next fastener driving procedure, the drive shafts do not have to be manually rotated towards each other in order to ensure that the disengaged coupler latches. During the axial movement of the drive shafts with respect to each other, that is to say, when they are pulled apart from each other, the coupler is engaged virtually automatically.

The insulation material plug has, for instance, an expanding area that can be widened by an expanding screw as the fastening means. On the shank or on the advantageously helically shaped pressure disk that forms an insulation material thread, there is a rotary carrier means, i.e. a receptacle, into which the third rotary carrier means, for example, an external polygon that matches the receptacle, engages at the first end of the second drive shaft in order to transfer the torque from the second drive shaft to the insulation material plug.

The first rotary carrier means for the fastening element at the first end of the first drive shaft is, for example, a screw driver insert configured on the rotary carrier means of the fastening means or a receptacle for a polygonal bit whose free end has a free end that can engaged into the rotary carrier means of the fastening means.

The second rotary carrier means for the fastening element on the second end of the first drive shaft is, for example, an insertion end that can be inserted into the tool-receiving socket of the fastener driving tool such as, for instance, a screwdriver or a power drill.

Moreover, an additional coupler can be advantageously provided at the second end of the first drive shaft and this coupler ensures an axial advancing force onto the fastener driving tool at the beginning of the fastener driving procedure. Manual pressure in the driving direction of the insulation material plug connects the additional coupler in order to transfer torque from the fastener driving tool to the first drive shaft. As a result, the insulation material plug is easily inserted into the drilled hole at the beginning of the fastener driving procedure. Due to this preceding insertion, the insulation material plug is aligned with the orientation of the drilled hole and the subsequent correct fastener driving procedure is made substantially easier, particularly for less experienced users. Owing to the rotational uncoupling due to the additional coupler, the user can guide an insulation material plug that has been placed onto the fastener driving tool into the drilled hole during the insertion procedure, while the fastener driving tool is already executing a rotational movement.

Preferably, several locking elements and, corresponding to the number of locking elements, several recesses are provided, whereby there is a groove starting from each recess. Consequently, the number of recesses advantageously matches the number of locking elements. Advantageously, the recesses and thus the locking elements are distributed uniformly along the circumference. In the case of, for example, three locking elements, these locking elements and the corresponding recesses are arranged offset from each other by 120°.

Preferably, the at least one recess and the adjacent groove are provided on the shank of the first drive shaft, which allows it to have a simple configuration. The at least one recess and the adjacent groove are created, for instance, by means of machining, on the appertaining part of the fastener driving tool such as, for example, on the shank of the first drive shaft.

Preferably, the groove can be provided along the circumference in such a way that the end of the groove facing away from the recess extends over an axial projection of a recess, resulting in an overlapping of the groove at least with an area of the recess. This advantageously ensures that the at least one locking elements is guided in the groove, irrespective of the position of the first drive shaft relative to the second drive shaft, when the drive shafts are offset relative to each other. It is ensured that the at least one locking element comes to lie in the groove in a transition area before engaging into the recess, so that the locking element is guided by the groove. This approach prevents the at least one locking element from coming to lie outside of a recess when the first drive shaft and the second drive shaft are in a state where they are separated from each other, and consequently the first drive shaft and the second drive shaft are not coupled.

If several recesses are provided, each with an adjacent groove, and if these are advantageously uniformly distributed along the circumference, then the helically running grooves advantageously extend over the angular range resulting from the number of provided grooves and their distribution. If the grooves are not distributed uniformly along the circumference, then the adjacent helical grooves advantageously extend over different angular ranges.

Preferably, starting from the recess, the depth of the groove diminishes in the direction of the end of the groove facing away from the recess, as a result of which the degree of guidance of the locking elements in the groove increases in the direction of the recess that is adjacent to the corresponding groove. If several recesses and thus several grooves are provided, then all of the grooves advantageously have the same configuration in terms of their depth, which ensures a simple engagement of the coupler. If several grooves are provided, these can also be, for instance, of different depths, which especially accounts for an advantageous engagement behavior of the coupler when the recesses along the circumference are not arranged uniformly.

Preferably, staring from the recess, the width of the groove diminishes in the direction of the end of the groove facing away from the recess, as a result of which the degree of guidance of the locking elements in the groove increases in the direction of the recess that is followed by the corresponding groove. If several recesses and thus several grooves are provided, all of the grooves advantageously have the same configuration in terms of their width, which ensures a simple engagement of the coupler. If several grooves are provided, these can also be, for instance, of different widths, which especially accounts for an advantageous engagement behavior of the coupler when the recesses are not arranged uniformly along the circumference.

Preferably, the cross section of the groove is configured to be trapezoidal or trough-shaped, which ensures an advantageous guidance of the at least one locking element as well as a simple shaping of the groove. Moreover, little or no notch stress is generated in the material of the corresponding part of the fastener driving tool when under load.

BRIEF DESCRIPTION OF THE DRAWINGS

The invention is explained in greater detail below on the basis of an embodiment. The following is shown.

The same parts are fundamentally designated by the same reference numerals in the figures.

DETAILED DESCRIPTION

Figure 1:
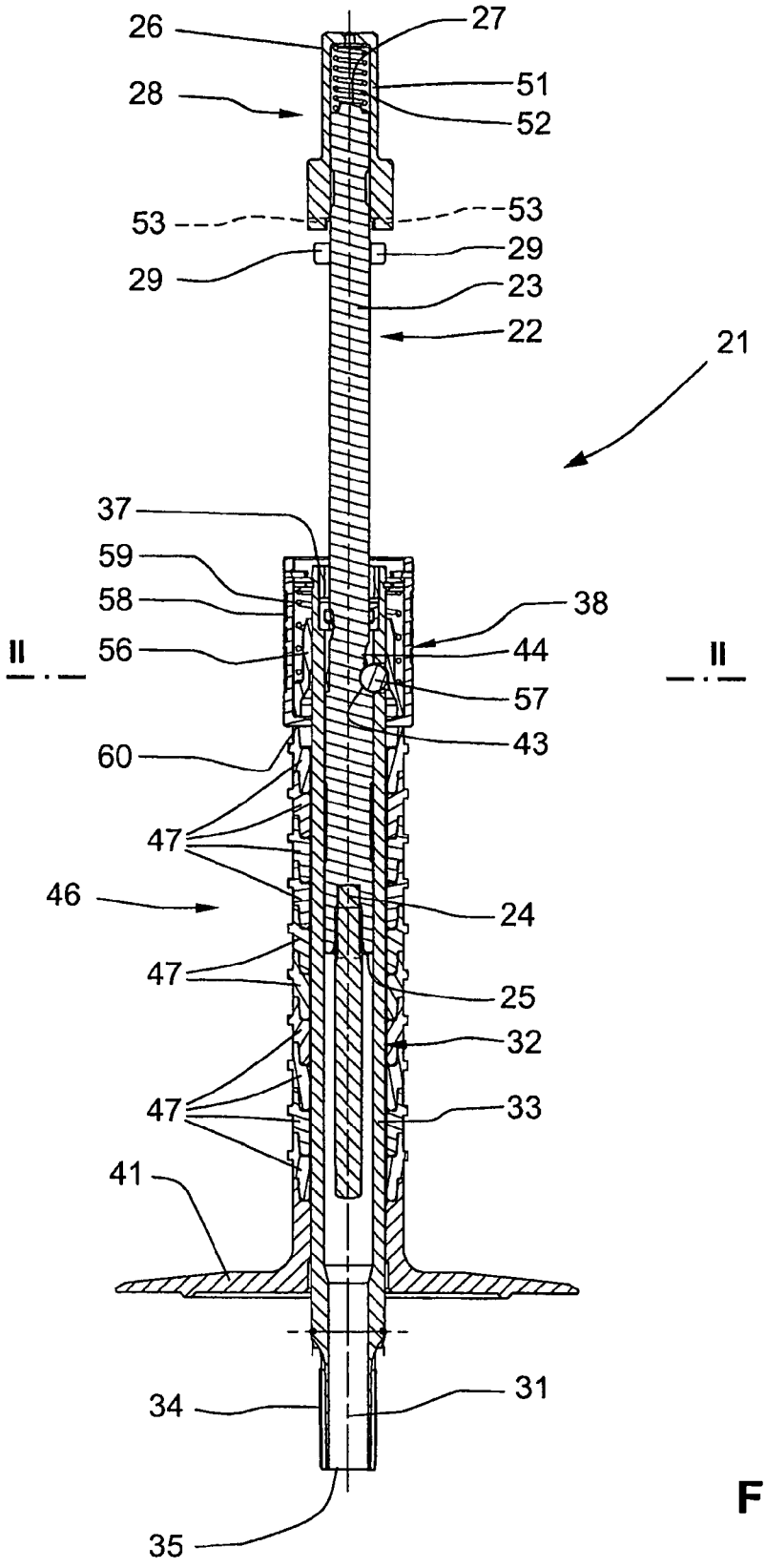
FIG. 1—a longitudinal section of a fastener driving tool.
Figure 2:
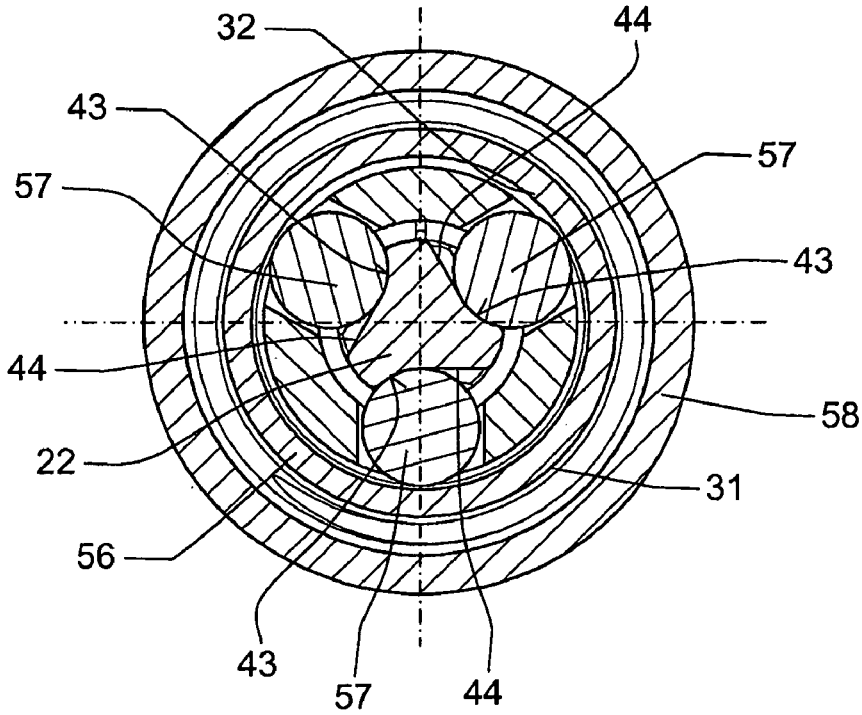
FIG. 2—a section along line II-II in FIG. 1.

The fastener driving tool 21 shown in FIGS. 1 to 3 and FIGS. 4A to 4A for an insulation material plug 11 that can be anchored with an expanding screw as the fastening means 16 in the substrate 6 has a first drive shaft 22 and a second drive shaft 32.

The first drive shaft 22 has a shank 23 that extends along the longitudinal axis 31, said shank 23 having a screwdriver bit receptacle as the first rotary carrier means 24 for the fastening means 16 at a first end 25 and having an insertion end as the second rotary carrier means 26 for an electric screwdriver as the fastener driving tool 8 at a second end 27 opposite from the first end 25. An additional coupler 28 is provided at the second end 27.

The additional coupler 28 includes a pot-shaped section 51 that runs coaxially over the second end 27 of the first drive shaft 22. The first drive shaft 22 has carrier cams 29 that protrude radially from the shaft and that can engage in cam receptacles 53 on the free end of the pot-shaped section 51. A spring element 52, for instance, a spiral spring that holds the additional coupler 28 in a disengaged position, is provided between the pot-shaped section 51 and an area of the second end 27.

The path for anchoring the fastening means can be specifically defined by a stop on the first drive shaft 22, said stop being located in an area of the second end 37 of the second drive shaft 32. For example, this stop is formed by the radially protruding carrier cam 29 on the first drive shaft 22 that comes into contact with the side of the housing 58 of the coupler 38 facing the second end 27 of the first drive shaft 22, thus preventing a further movement of the first drive shaft 22 relative to the second drive shaft 32 in the fastener driving direction. This ensures a uniform, defined anchoring of the insulating material plug 11 by the fastening element 16.

The second drive shaft 32 is arranged coaxially to the first drive shaft 22 and has a hollow shank 33 with an external polygon as the third rotary carrier means 34 for the insulation material plug 11 at a first end 35. A coupler 38 that can be disengaged by means of axial pressure is provided in an area located at a distance from the first end 35 of the second drive shaft 32 which, in this embodiment, corresponds to the second end 37 of the second drive shaft 32.

The coupler 38 includes three locking elements 57 in the form of balls which, in order to transfer a torque from the first drive shaft 22 to the second drive shaft 32, engage with three recesses 43 that are arranged uniformly along the circumference, that is to say, at a radial distance of 120° with respect to each other. Each of the recesses 43 is adjacent to a groove 44 that serves to guide the locking elements 57 that are directly adjacent to the recess and that, starting from the recesses 43, helically extend in areas along the circumference in the direction of the second end 27 of the first drive shaft 22. The recesses 43 and the adjacent grooves 44 are provided on the shank 23 of the first drive shaft 22.

Figure 3:
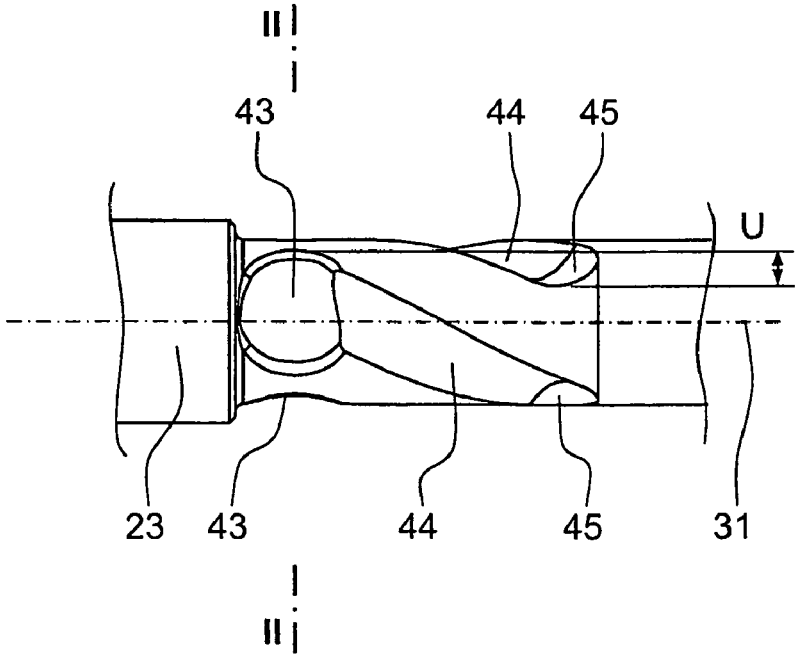
FIG. 3—a detailed view of a shank section of the first drive shaft.

The grooves 44 are provided along the first drive shaft 22 in such a way that the end 45 of the groove 44 facing away from the corresponding recess 43 extends over an axial projection of an adjacent recess 44. In this example, the grooves 44 extend essentially over an angular range of about 120°. In FIG. 3, this overlapping of the grooves 44 with the axial projection of an adjacent recess 44 is designated by the letter U.

The depth and the width of the grooves 44 decreases starting at the recess 43 in the direction of the end 45 of the groove 44 facing away from the recess 43. Instead of the depicted trough-shaped configuration of the cross section of the grooves 44, their cross section can also be configured to be trapezoidal. The depth of the recesses 43 is configured to be greater than the maximum depth of the grooves 44.

The coupler 38 is surrounded by a housing 58 that protrudes beyond the radial projection of the second drive shaft 32. A spring element 59, for instance, a spiral spring that biases a clamping ring 56 in the direction of the first end 25 of the first drive shaft 22, is provided in the housing 58. The clamping ring 56 forces the locking elements 57 in the direction of the first drive shaft 22, as a result of which the coupler 38 is held in an engaged state.

Furthermore, a stop disk 41 that is mounted so as to be axially movable relative to the longitudinal axis 31 is provided on the second drive shaft 32, and the axial distance of said stop disk from the first end 35 of the second drive shaft 32 can be preselected by means of a positioning mechanism 46. This positioning mechanism 46 includes several spacers 47 that are arranged one after the other between the stop disk 41 and a stop 60 on the second drive shaft 32. The stop 60 is formed by a section of the housing 58 of the coupler 38 that protrudes beyond the radial projection of the second drive shaft 32 between the first drive shaft 22 and the second drive shaft 32.

The spacers 47 are configured to be essentially hollow and cylindrical and, for purposes of a simple arrangement on the second drive shaft 32, they each have a lengthwise slit that extends over the entire axial length of the spacer 48. If necessary, these spacers 48 can be simply placed on the second drive shaft 32. Advantageously, these spacers 48 are made of a radially elastic material, which allows them to be easily clipped onto the second drive shaft 32 during assembly.

As an alternative, the spacers 47 are configured to be hollow and cylindrical and closed along their circumference. In order to select the driving depth of the insulation material plug 11, such spacers 48 are slipped over the first end 35 of the second drive shaft 32 onto its shank 33 as the need arises.

Figure 4C:
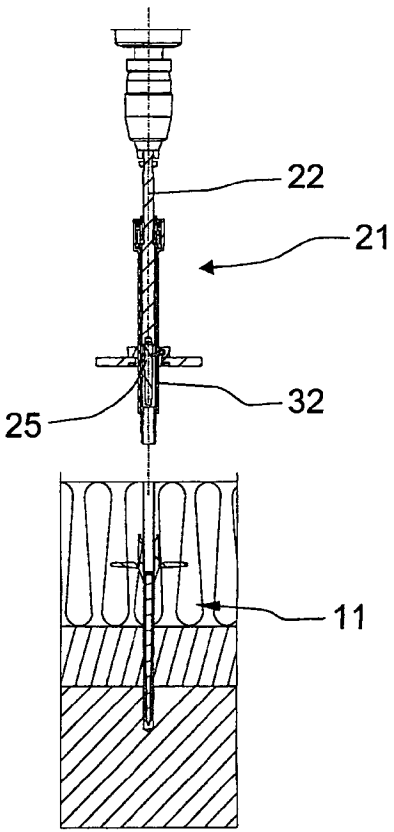
FIG. 4—the fastener driving procedure with the fastener driving tool according to the invention in three states of assembly.
Figure 4B:
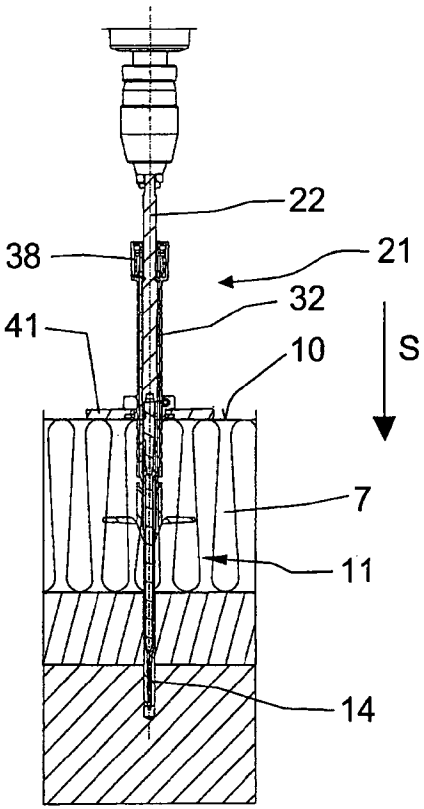
Figure 4A:
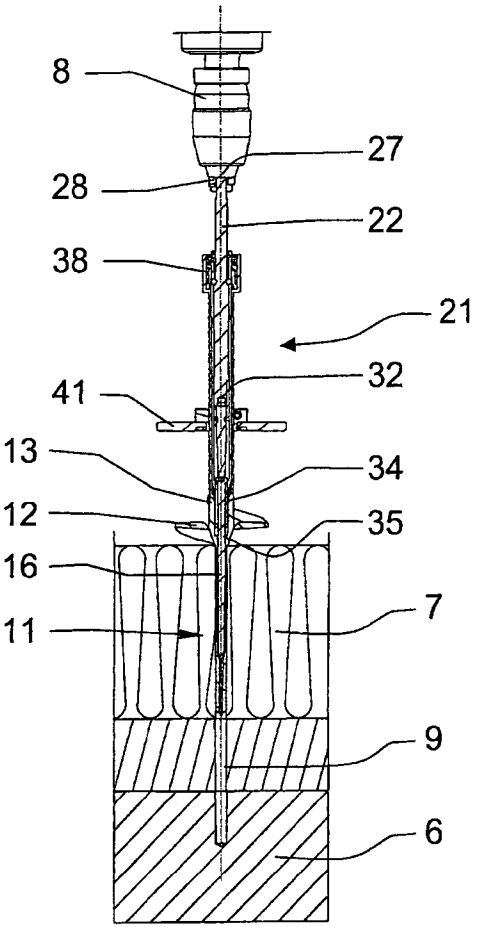

The fastener driving procedure of an insulation material plug 11 using the fastener driving tool 21 according to the invention is explained below making reference to FIGS. 4A to 4C.

The insulation material plug 11 is provided with the expanding screw as the fastening means 16 and is placed in its entirety onto the fastener driving tool 21 and subsequently inserted into the hole 9 drilled into the substrate 6 all the way through the insulating panel 7 that is to be fastened (see FIG. 3A). As an alternative, the insulation material plug 11, together with the expanding screw, is first inserted into the drilled hole 9 and then the fastener driving tool 21 is coupled to the insulation material plug 11. At one end, the insulation material plug 11 has a helical pressure disk 12 or an insulation thread as well as a receptacle as the rotary carrier means 13 that can engage in the third rotary carrier means 34 on the first end 35 of the second drive shaft 32 in order to transfer the torque from the second drive shaft 32 to the insulation material plug 11. Previously, the stop disk 41 was moved axially along the second drive shaft 32 by means of the positioning device 46 in order to select the desired fastener driving depth of the insulation material plug 11.

Pressure in the fastener driving direction S of the insulation material plug 11 engages the additional coupler 28 that is arranged on the second end of the first drive shaft 22, so that the torque generated by the fastener driving tool 8 is transferred to the first drive shaft 22 and from there to the second drive shaft 32 by means of the coupler 38.

Once the desired fastener driving depth of the insulation material plug 11 has been reached (see FIG. 4B), the stop disk 41 is resting against the surface 10 of the insulation panel 7. When the fastener driving tool 21 advances further in the fastener driving direction S, the pressure on the coupler 38 between the second drive shaft 32 and the first drive shaft 22 is increased so that the coupler is disengaged, thereby interrupting the transfer of the torque from the first drive shaft 22 to the second drive shaft 32 and thus to the insulation material plug 11. The first drive shaft 22 continues to be rotationally driven, so that the fastening means 16 can be driven further in order to expand the anchoring area 14 of the insulation material plug 11.

The third rotary carrier means 34 on the second drive shaft 32 advantageously has a conical shape, so that a frictional grip or clamping between the third rotary carrier means 34 and the rotary carrier means 13 of the insulation material plug 11 is brought about when the insulation material plug 11 is driven. Since the holding force between the fastener driving tool 21 and the insulation material plug 11 can be easily disconnected, the second drive shaft 32 is automatically brought into the front, coupled initial position when the fastener driving tool 21 is withdrawn after completion of the fastener driving procedure (see FIG. 4C).

When the locking elements 57 come to lie in the area of the grooves 44, the locking elements 57 are guided by the latter until they engage into the corresponding recess 43. Now the fastener driving tool 21 is ready for the next fastener driving procedure for another insulation material plug 11, which is driven exactly and correctly to the proper depth as was the case with the previously driven insulation material plug 11.

If, in an exceptional case, it turns out that no clamping occurs between the fastener driving tool 21 and the insulation material plug 11 during a fastener driving procedure, then the second drive shaft 32 can be manually moved to the front again in the direction of the first end 25 of the first drive shaft 22 until the coupler 38 once again non-rotatably couples the first drive shaft 22 to the second drive shaft 32.

What is claimed is:

1. A fastener driving tool for an insulation material plug anchorable with a fastener in a substrate, comprising:

a first drive shaft having a shank extending along a longitudinal axis and having a first end and a second end opposite the first end;

a first rotary carrier for the fastener at the first end and a second rotary carrier for a fastener driving tool device at the second end;

a second drive shaft arranged coaxially to the first drive shaft, the second drive shaft having a hollow shank with a third carrier for the insulation material plug at a second drive shaft first end; and a coupler disengageable by axial pressure and arranged in an area at a distance from second drive shaft first end, the coupler including at least one locking element engaging into at least one recess in order to transfer a torque from the first drive shaft to the second drive shaft, a groove guiding the at least one locking element, the groove being adjacent to the at least one recess and, starting from the at least one recess, extending helically, at least in some areas, along a circumference in a direction of the second end of the first drive shaft.

2. The fastener driving tool according to claim 1, wherein the at least one locking element includes several locking elements and, corresponding to the number of locking elements, several recesses of the at least one recess are provided, whereby a groove starts from each recess.

3. The fastener driving tool according to claim 1, wherein in that at least one recess and the adjacent groove are provided on the shank of the first drive shaft.

4. The fastener driving tool according to claim 1, wherein the groove is provided along the circumference in such a way that an end of the groove facing away from the recess extends over an axial projection of an adjacent recess.

5. The fastener driving tool according to claim 1, wherein starting from the recess, a depth of the groove diminishes in a direction of an end of the groove facing away from the recess.

6. The fastener driving tool according to claim 1, wherein starting from the recess, a width of the groove diminishes in a direction of an end of the groove facing away from the recess.

7. The fastener driving tool according to claim 1, wherein a cross section of the groove is configured to be trapezoidal.

* * * * *